US007591714B2

(12) United States Patent
Ko et al.

(10) Patent No.: US 7,591,714 B2
(45) Date of Patent: Sep. 22, 2009

(54) WAFER GRINDING AND TAPE ATTACHING APPARATUS AND METHOD

(75) Inventors: Jun-Young Ko, Cheonan-si (KR); Dae-Sang Chan, Cheonan-si (KR); Sang-Jun Kim, Cheonan-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/397,883

(22) Filed: Apr. 5, 2006

(65) Prior Publication Data

US 2007/0099550 A1 May 3, 2007

(30) Foreign Application Priority Data

Oct. 27, 2005 (KR) ..... 10-2005-0101729

(51) Int. Cl.
*B25B 7/00* (2006.01)

(52) U.S. Cl. ..... 451/54; 451/57; 451/65; 451/67; 451/285; 451/287; 451/397; 451/398; 451/402

(58) Field of Classification Search ..... 451/54, 451/57, 65, 67, 285, 287, 397, 398, 402
See application file for complete search history.

(56) References Cited

U.S. PATENT DOCUMENTS

| | | | | |
|---|---|---|---|---|
| 6,048,749 | A * | 4/2000 | Yamada | 438/64 |
| 6,153,536 | A * | 11/2000 | Brouillette et al. | 438/758 |
| 6,837,776 | B2 * | 1/2005 | Shimobeppu et al. | 451/41 |
| 7,051,428 | B2 * | 5/2006 | Jeong et al. | 29/729 |
| 7,080,675 | B2 * | 7/2006 | Yamamoto | 156/538 |

FOREIGN PATENT DOCUMENTS

KR 10-2004-0007344 1/2004

* cited by examiner

*Primary Examiner*—Joseph J Hail, III
*Assistant Examiner*—Shantese McDonald
(74) *Attorney, Agent, or Firm*—Harness, Dickey & Pierce

(57) ABSTRACT

A wafer grinding and tape attaching apparatus and method, the method includes providing a wafer to a chuck table, grinding a back side of the wafer, providing a wafer ring having dicing tape and attaching the dicing tape to the back side of the ground wafer.

18 Claims, 19 Drawing Sheets

WAFER GRINDING AND TAPE ATTACHING APPARATUS AND METHOD

PRIORITY STATEMENT

This U.S. non-provisional application claims benefit of priority under 35 U.S.C. §119 of Korean Patent Application No. 2005-101729, filed on Oct. 27, 2005, the entire contents of which are incorporated herein by reference.

BACKGROUND OF THE INVENTION

1. Field of the Invention

The present invention relates to an apparatus and method for fabricating a semiconductor package, and more particularly, to an apparatus and method for grinding a back side of a wafer and attaching dicing tape to the back side of a wafer.

2. Description of the Related Art

Conventionally, a wafer fabrication process may use a relatively thick wafer because a wafer may be damaged during handling. The back side of the wafer may be ground to reduce the thickness of the wafer.

For example, an 8-inch diameter wafer may have an initial thickness between 730 μm and 750 μm, and a 12-inch diameter wafer may have an initial thickness between 790 μm and 800 μm. After a grinding process, the wafers may have a final thickness within the range of 50 μm to 450 μm. The final thickness may vary depending on the semiconductor product, demand of users, product characteristics, etc.

For a wafer sawing process, a dicing tape may be attached to the back side of the thinned and/or ground wafer. Conventionally, a robot arm may transfer a wafer to a dicing tape attaching apparatus, and the dicing tape attaching apparatus may attach the dicing tape to the wafer. A wafer may be provided to the dicing tape attaching apparatus while the wafer is loaded in a wafer cassette. If a wafer grinding apparatus is installed in-line with a dicing tape attaching apparatus, the wafer may be directly provided to the dicing tape attaching apparatus. The attachment of the dicing tape to the wafer may reduce a chip separation fault which may occur to the package during a wafer sawing process.

Conventionally, an in-line wafer grinding and tape attaching apparatus may include a wafer grinding apparatus and a tape attaching apparatus. The wafer grinding apparatus may include a turntable having a plurality of chuck tables installed thereon. The tape attaching apparatus may be installed near the wafer grinding apparatus and may be configured to attach a dicing tape to a back side of a wafer and/or remove a protection tape from a front side of a wafer.

Referring to FIGS. 1A and 1B, a robot arm 3 may transfer a wafer 60 between a wafer grinding apparatus and a tape attaching apparatus. For example, the robot arm 3 may adsorb the wafer 60 using a vacuum and may transfer the wafer 60 to the tape attaching apparatus.

The thinner the wafer 60 is, the more the wafer may be subject to warpage. The wafer 60 may have a front side 61 with an integrated circuit layer and a silicon layer. The thickness of the silicon layer may be reduced by a grinding process. Further, the coefficient of thermal expansion of the silicon layer may be different from that of the integrated circuit layer, and the wafer 60 may be bent toward the front side 61 of the wafer as shown in FIG. 1B.

As a result, if a robot arm 3 transfers the wafer 60 using a vacuum, the vacuum may leak through the bent portion of the wafer 60, and the connection between the robot arm 3 and the wafer my be lost. Accordingly, the wafer 60 may be dropped by the robot arm 3.

A wafer 60 may be inadvertently dropped from the robot arm 3 as described above during processes resulting in lost time and resources. For example, a wafer 60 may be inadvertently dropped during a process for loading a wafer to a wafer cassette, a process for removing a protection tape from a wafer and/or a process for attaching dicing tape to a wafer.

SUMMARY OF THE INVENTION

An example embodiment of the present invention is directed to stably handling a thinned wafer without damaging the wafer.

An example embodiment of the present invention is directed to providing a wafer grinding and tape attaching apparatus and method.

According to an example embodiment of the present invention, an apparatus may include a wafer providing unit, a grinding unit, a tape attaching unit and a wafer ring receiving unit. The wafer providing unit may be configured to provide a wafer having a front side and a back side. The grinding unit may be configured to grind the back side of the wafer. The grinding unit may include chuck tables configured to support the wafer and grinding wheels located on the chuck tables. The tape attaching unit may be configured to provide a wafer ring having a dicing tape to the chuck table having the wafer so the dicing tape may be attached to the back side of the ground wafer. The wafer ring receiving unit may be configured to receive the wafer ring having the ground wafer.

According to an example embodiment of the present invention, a wafer providing unit may include a wafer cassette configured to contain a wafer before a grinding process, an alignment table configured to align the wafer, and a loader configured to transfer the wafer from the wafer cassette to the alignment table and from the alignment table to a grinding unit.

According to an example embodiment of the present invention, a chuck table may include a buffer table configured to provide a wafer and/or a wafer ring having the wafer, and at least one grinding table located near the buffer table and configured to grind the back side of the wafer.

According to an example embodiment of the present invention, a grinding unit may further include a turntable having chuck tables radially arranged thereon. The turntable may be rotated to change the positions of the chuck tables.

According to an example embodiment of the present invention, a tape attaching unit may include a wafer ring cassette located near a buffer table and configured to contain a wafer ring, a first transfer configured to transfer a wafer ring from the wafer ring cassette to the buffer table and unload the wafer ring having the wafer from the grinding unit, and a roller configured to attach the dicing tape to the back side of the ground wafer.

According to an example embodiment of the present invention, a tape attaching unit may include a wafer ring container configured to contain a wafer ring, a tape attaching device configured to attach dicing tape to the wafer ring, a first transfer configured to load the wafer ring to the buffer table having the wafer and unload the wafer ring having the ground wafer from the grinding unit, and a roller configured to attach dicing tape to the back side of the ground wafer.

According to an example embodiment of the present invention, a tape attaching unit may also include a second transfer configured to flip a ground wafer so the front side of the ground wafer faces upward.

According to an example embodiment of the present invention, a wafer may have a protection adhesive, and an apparatus according to an example embodiment of the present invention may include a tape remover configured to remove the protection adhesive from a ground wafer.

According to an example embodiment of the present invention, a wafer ring receiving unit may include an unloader configured to unload a wafer ring from a tape remover, and a wafer ring cabinet configured to receive the wafer ring.

According to an example embodiment of the present invention, a method for wafer grinding and tape attaching may include providing a wafer to a chuck table, the wafer having a back side facing upward. The back side of the wafer may be supported on the chuck table and may be ground by a grinding wheel. A wafer ring having dicing tape may be provided to the chuck table having the ground wafer. The dicing tape may be attached to the back side of the ground wafer. The wafer ring having the ground wafer may be unloaded from the chuck table.

According to an example embodiment of the present invention, providing a wafer ring may include preparing a wafer ring cassette having the wafer ring and transferring the wafer ring to the chuck table having the ground wafer to mount the dicing tape to the back side of the ground wafer.

According to an example embodiment of the present invention, providing a wafer ring may include preparing a wafer ring container having the wafer ring, attaching the dicing tape to the wafer ring, and transferring the wafer ring having the dicing tape to the chuck table having the wafer to mount the dicing tape to the back side of the ground wafer.

According to an example embodiment of the present invention, attaching dicing tape to the back side of a ground wafer may include pressing a roller onto the back side of the ground wafer using heat to adhere dicing tape to the back side of the ground wafer.

According to an example embodiment of the present invention, a method for wafer grinding and tape attaching may also include removing protection tape from a ground wafer and receiving a wafer ring having the wafer in a wafer ring cabinet.

According to an example embodiment of the present invention, a method for wafer grinding and tape attaching may also include flipping a wafer ring before removing protection tape so the front side of a ground wafer faces upward.

BRIEF DESCRIPTION OF THE DRAWINGS

Example embodiments of the present invention will be readily understood with reference to the following detailed description thereof provided in conjunction with the accompanying drawings, wherein like reference numerals designate like structural elements.

Figure 1A:
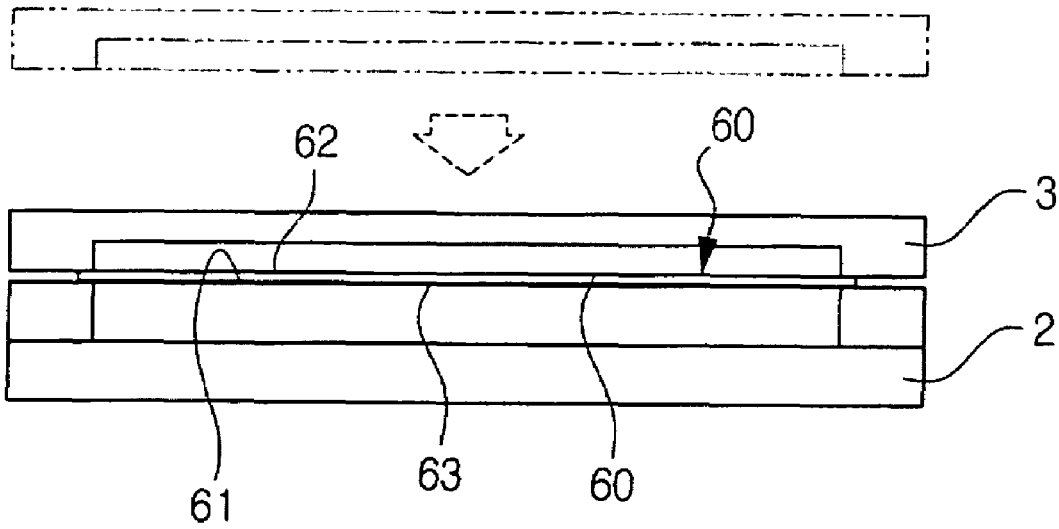
FIG. 1A ( Conventional Art )
FIG. 1A is a cross-sectional view of a conventional process for transferring a thinned wafer.
Figure 1B:
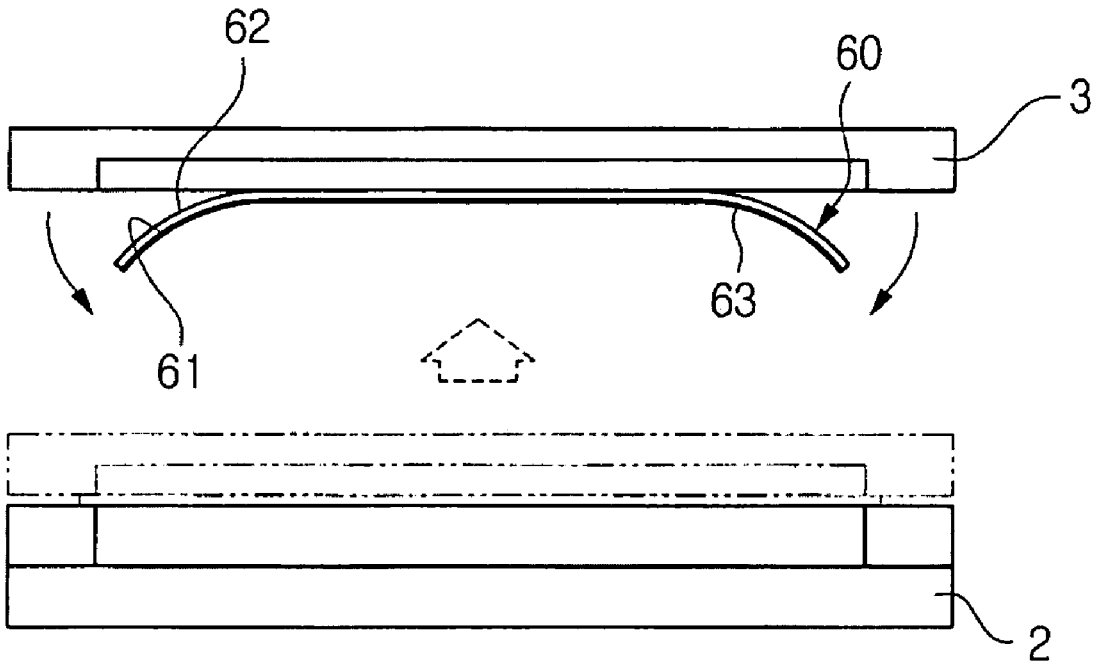
FIG. 1B ( Conventional Art )
FIG. 1B is a cross-sectional view illustrating warpage of a wafer of FIG. 1A.

These drawings are provided for illustrative purposes only and are not drawn to scale. The spatial relationships and/or relative sizing of the elements illustrated in the various embodiments may have been reduced, expanded and/or rearranged to improve the clarity of the figure with respect to the corresponding description. The figures, therefore, should not be interpreted as accurately reflecting the relative sizing and/or positioning of the corresponding structural elements that could be encompassed by an actual device manufactured according to example embodiments of the present invention.

DETAILED DESCRIPTION OF EXAMPLE EMBODIMENTS

Various example embodiments of the present invention will now be described more fully with reference to the accompanying drawings in which some example embodiments of the invention are shown. In the drawings, the thicknesses of layers and regions may be exaggerated for clarity.

Detailed illustrative embodiments of the present invention are disclosed herein. However, specific structural and functional details disclosed herein are merely representative for purposes of describing example embodiments of the present invention. Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the FIGs. For example, two FIGs. shown in succession may in fact be executed substantially concurrently or may sometimes be executed in the reverse order, depending upon the functionality/acts involved.

Further, well-known structures and processes are not described or illustrated in detail to avoid obscuring example embodiments of the present invention. Like reference numerals are used for like and corresponding parts of the various drawings.

Figure 2:
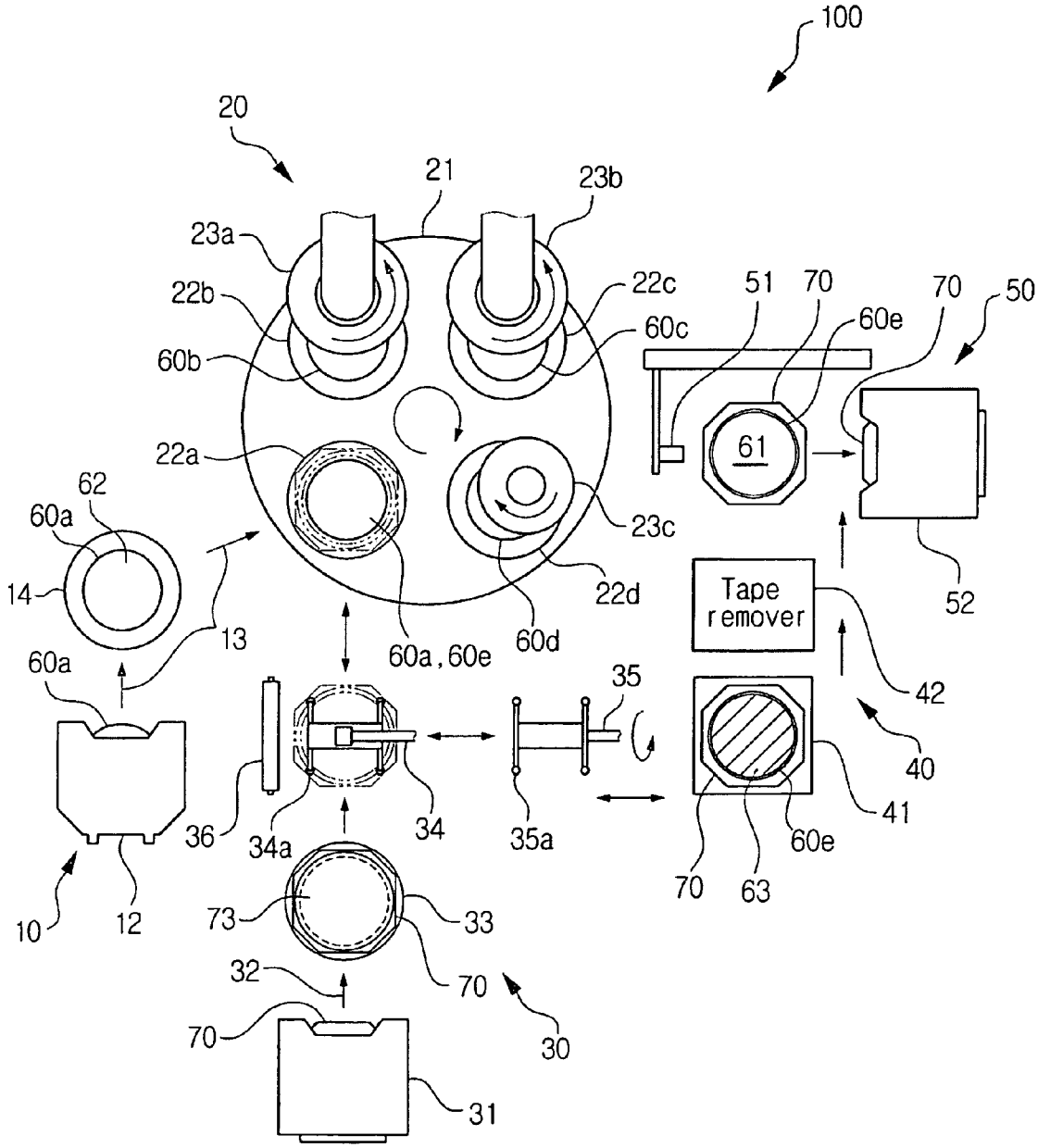
FIG. 2 is a schematic view of a wafer grinding and tape attaching apparatus in accordance with an example embodiment of the present invention.

FIG. 2 is a schematic view of a wafer grinding and tape attaching apparatus 100 according to an example embodiment of the present invention. FIG. 4B is a cross-sectional view of a wafer supported on a chuck table according to an example embodiment of the present invention.

Referring to FIGS. 2 and 4B, a wafer grinding and tape attaching apparatus 100 may include a wafer providing unit 10, a grinding unit 20, a tape attaching unit 30, a protection tape removing unit 40, and a wafer ring receiving unit 50.

The wafer providing unit 10 may be configured to provide a wafer 60*a* to the grinding unit 20 for a grinding process. The wafer providing unit 10 may include a wafer cassette 12, an alignment table 14 and a loader 13. The wafer cassette 12 may contain a wafer 60*a*. The wafer 60*a* may face downward in the wafer cassette 12. The alignment table 14 may align the wafer 60*a* on the alignment table 14 and/or grinding unit 20. The loader 13 may transfer the wafer 60*a* from the wafer cassette 12 to the alignment table 14 and from the alignment table 14 to the grinding unit 20. The loader 13 may use a transfer arm for transferring the wafer 60*a* using mechanical contact. The wafer 60*a* may have a front side 61 with a protection tape 63 and a back side 62 opposite to the front side 61. The protection tape 63 may protect integrated circuits on the front side 61 of the wafer 60*a* during a grinding process and may be removed from the front side 61 of the wafer 60*a* after the grinding process. The protection tape 63 may include, use and/or be an ultraviolet tape.

The grinding unit 20 may include a turntable 21, a plurality of chuck tables 22*a*, 22*b*, 22*c* and 22*d* arranged on the turntable 21, and grinding wheels 23*a*, 23*b* and 23*c*. The turntable 21 may be configured to support the wafers 60*a*, 60*b*, 60*c*, 60*d* and 60*e* using a vacuum connection, for example. The chuck tables 22*a*, 22*b*, 22*c* and 22*d* may include a first chuck table 22*a*, second chuck table 22*b*, third chuck table 22*c* and fourth chuck table 22*d*. The grinding wheels 23*a*, 23*b* and 23*c* may be installed on the chuck tables 22*b*, 22*c* and 22*d*.

According to an example embodiment of the present invention, chuck tables 22*a*, 22*b*, 22*c* and 22*d* may be radially arranged on a turntable 21, and a turntable 21 may rotate in a clockwise direction to change the positions of the chuck tables 22*a*, 22*b*, 22*c* and 22*d*.

According to an example embodiment of the present invention, a first chuck table 22*a* may serve as a buffer table for temporarily holding a wafer 60*a*. A second chuck table 22*b*, third chuck table 22*c* and fourth chuck table 22*d* may serve as grinding tables for grinding the wafers 60*b*, 60*c* and 60*d*. The second chuck table 22*b* may grind the back side of a wafer 60*b* using the grinding wheel 23*a*, which may have a rough surface. The third chuck table 22*c* may grind the back side of a wafer 60*c* using the grinding wheel 23*b*, which may have a fine surface. The fourth chuck table 22*d* may polish the back side of a wafer 60*d* using a slurry and the grinding wheel 23*c*, which may have a polishing pad. The fourth chuck table 22*d* may further clean the back side of a wafer 60*d*. After a grinding process, a wafer 60*e* may be returned to the first chuck table 22*a*.

Referring to an example embodiment of the present invention shown in FIG. 4B, a first chuck table 22*a* may have a table body 24 and an adsorption plate 25. The adsorption plate 25 may be provided on the table body 24 and may be formed from a porous material. The first chuck table 22*a* may be configured to support a front side 61 of a wafer 60*a* and/or 60*e*. The first chuck table 22*a* may uniformly support the front side 61 of the wafer 60*a* and/or 60*e*. The size of the first chuck table 22*a* may be such that a wafer ring may be placed on the table body 24 extending the adsorption plate 25.

According to an example embodiment of the present invention, a tape attaching unit 30 may be configured to attach dicing tape 73 to the back side 62 of a thinned wafer 60*e* (e.g., a wafer that has undergone a grinding process). The tape attaching unit 30 may provide a wafer ring 70 having the dicing tape 73 attached thereto and/or supported thereon to the first chuck table 22*a* supporting the wafer 60*e* to adhere the dicing tape 73 to the back side 62 of the wafer 60*e*. The tape attaching unit 30 may include a wafer ring cassette 31, a first transfer 34 and a roller 36. The wafer ring cassette 31 may be installed near the first chuck table 22*a* and may be configured to contain the wafer ring 70 having dicing tape 73. The first transfer 34 may transfer the wafer ring 70 from the first wafer ring cassette 31 to first chuck table 22*a*. The roller 36 may be configured to adhere the dicing tape 73 to the back side 62 of the wafer 60*e*. The first transfer 34 may further be configured to unload the wafer 60*e* having the dicing tape 73 adhered thereto from the grinding unit 20.

A transfer arm 32 may transfer the wafer ring 70 from the wafer ring cassette 31 to a buffer stage 33. According to an example embodiment of the present invention, a buffer stage 33 may temporarily hold the wafer ring 70 for a tape attaching process. At this time, the wafer ring 70 may have a dicing tape attaching surface facing upward.

A first transfer 34 may have an adsorption unit 34*a* for picking up the wafer ring 70 using vacuum, for example. The first transfer 34 may transfer the wafer ring 70 from the buffer stage 33 to the first chuck table 22*a* and from the first chuck table 22*a* to a protection tape removing unit 40.

A roller 36 may be placed outside the turntable 21 adjacent to the first chuck table 22*a* when a wafer ring 70 is provided to the first chuck table 22*a*. The roller 36 may attach the dicing tape 73 of the wafer ring 70 to the back side 62 of the wafer 60 using pressure and heat, for example.

According to an example embodiment of the present invention, a tape attaching unit 30 may also include a second transfer 35. The second transfer 35 may be configured to flip the wafer ring 70 so the front side 61 of the wafer 60 faces upward, for example. The second transfer 35 may have the same structure as the first transfer 34. However, the second transfer may be positioned lower than the first transfer 34. The second transfer 35 may receive the wafer ring 70 from the first transfer 34 and may transfer the wafer ring 70 to a protection tape removing unit 40.

A protection tape removing unit 40 may remove the protection tape 63 from the front side 61 of the wafer 60. The protection tape removing unit 40 may include an ultraviolet (UV) irradiator 41 and/or a tape remover 42. The UV irradiator 41 may irradiate the protection tape 63 with UV rays, which may reduce the adhesive strength of the protection tape 63. The tape remover 42 may peel off the protection tape 63 from the front side 61 of the wafer 60. For example, an adhesive tape for removal may be attached to the protection tape 63, after the protection tape 63 has been irradiated with UV rays. The tape remover 62 may remove the adhesive tape for removal to peel off the protection tape 63 from the front side 61 of the wafer 60.

The wafer ring receiving unit 50 may include an unloader 51 and a wafer ring cabinet 52. The unloader 51 may transfer the wafer ring 70 having the wafer 60*e* to the wafer ring cabinet 52.

Figure 3:
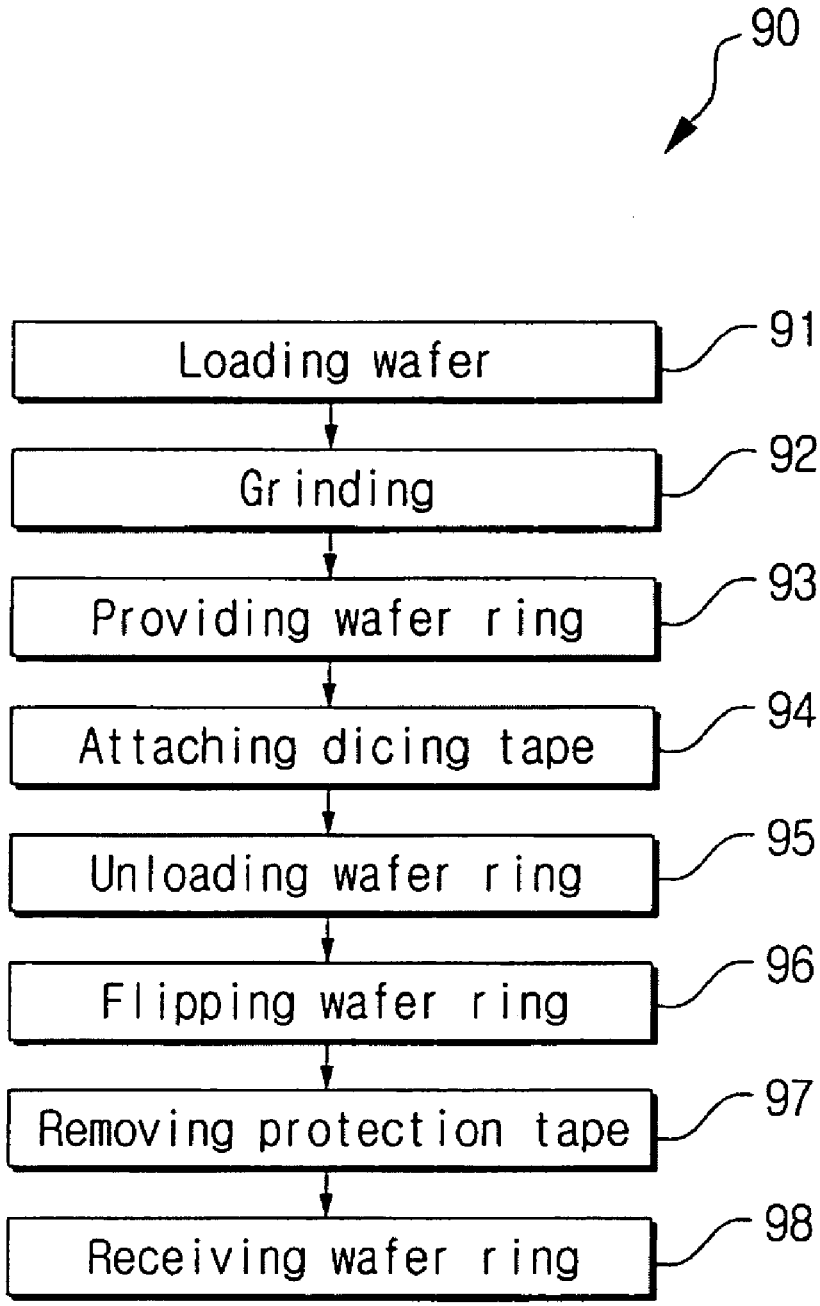
FIG. 3 is a flow chart of method for wafer grinding and tape attaching according to an example embodiment of the present invention shown.

FIG. 3 is a flow chart 90 of a method for wafer grinding and tape attaching, which may be implemented by an apparatus 100 of an example embodiment of the present invention as shown in FIG. 2. FIGS. 4A through 11 are views illustrating a method for wafer grinding and tape attaching according to an example embodiment of the present invention.

Figure 4A:
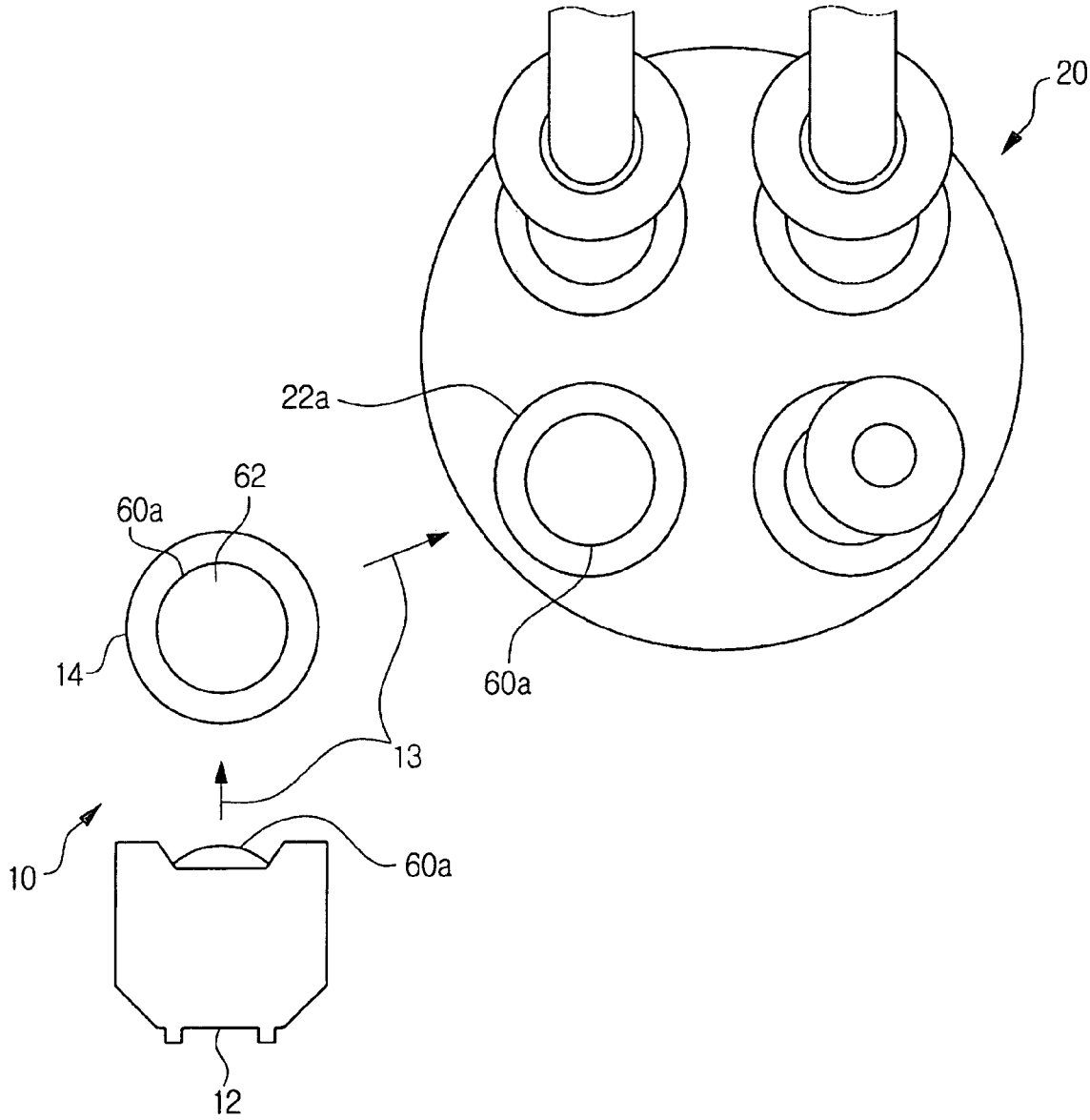
FIGS. 4A through 11 are views illustrating a method for wafer grinding and tape attaching in accordance with an example embodiment of the present invention.
Figure 4B:
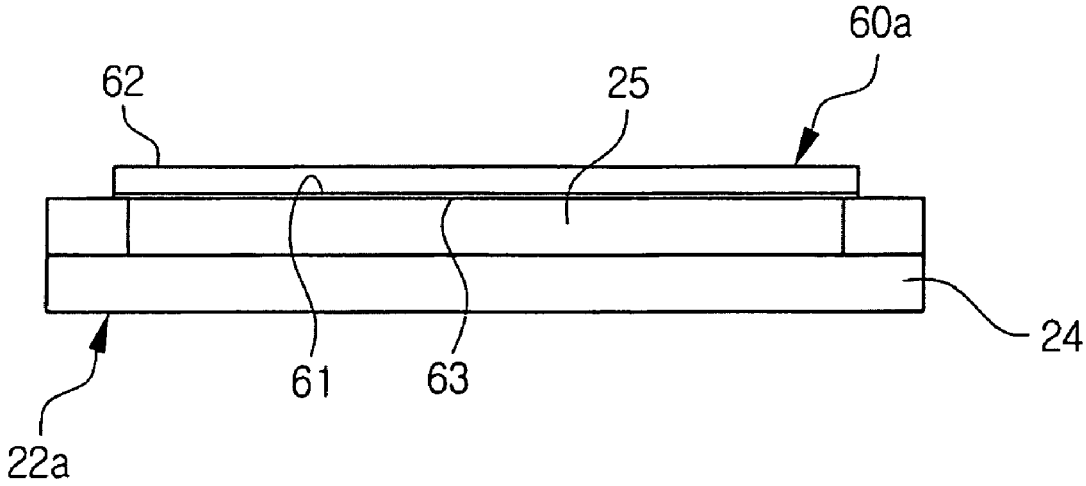

Referring to an example embodiment of the present invention shown in FIGS. 4A and 4B, a method for wafer grinding and tape attaching may begin with loading a wafer 60*a* to a grinding unit 20 (91 of FIG. 3). For example, the wafer 60*a* in a wafer cassette 12 may be transferred to an alignment table 14 by a loader 13. The wafer 60*a* may be aligned in and/or on an alignment table 14 and may be transferred to a first chuck table 22*a* of the grinding unit 20 by the loader 13. The wafer 60*a* may have a front side 61 with a protection tape 63 attached thereto and a back side 62. The wafer 60*a* may be transferred to the first chuck table 22*a*. The back side 62 of the wafer 60*a* may face upward as shown in FIGS. 4A and 4B.

Figure 5A:
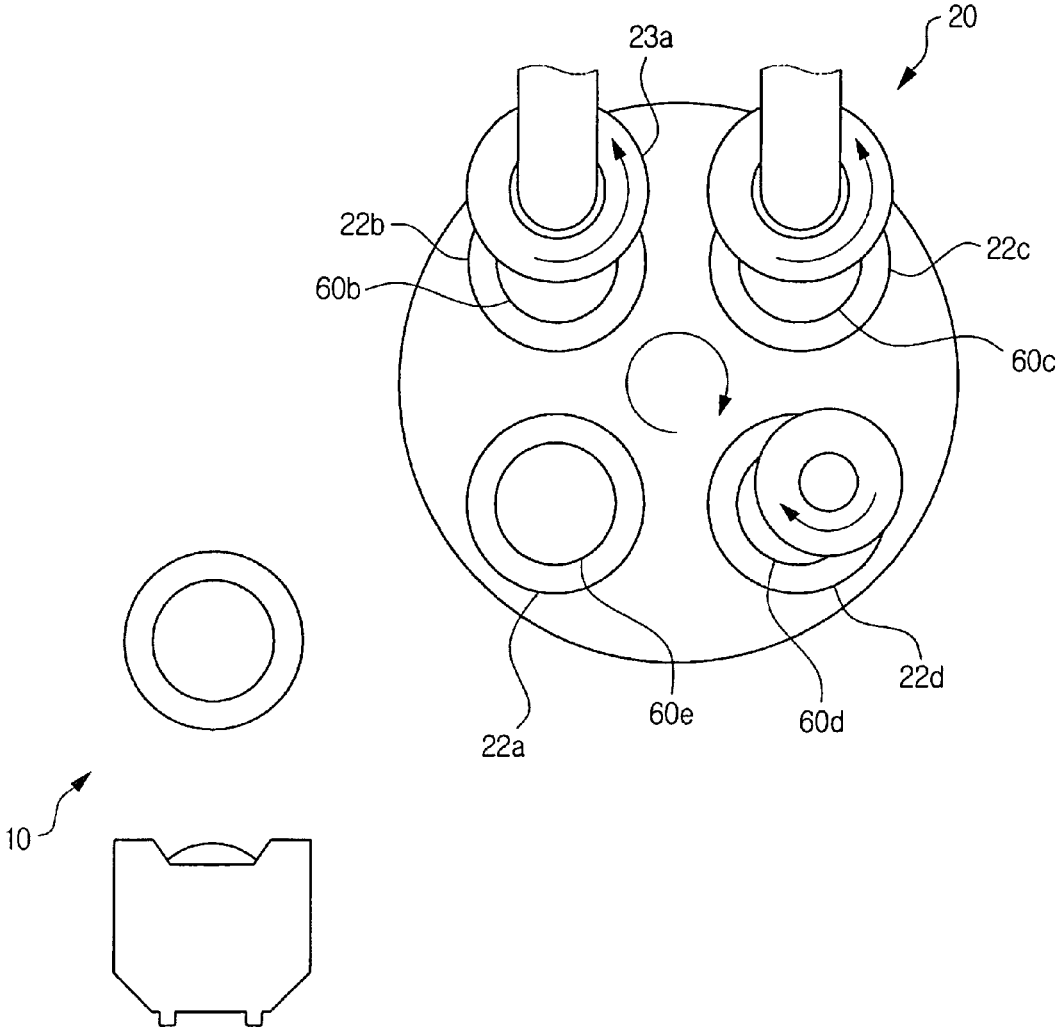
Figure 5B:
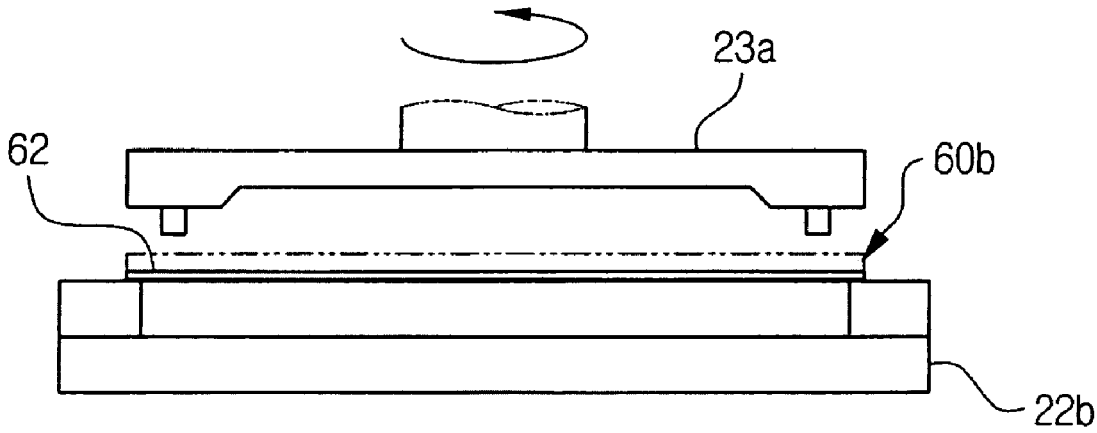
Figure 6A:
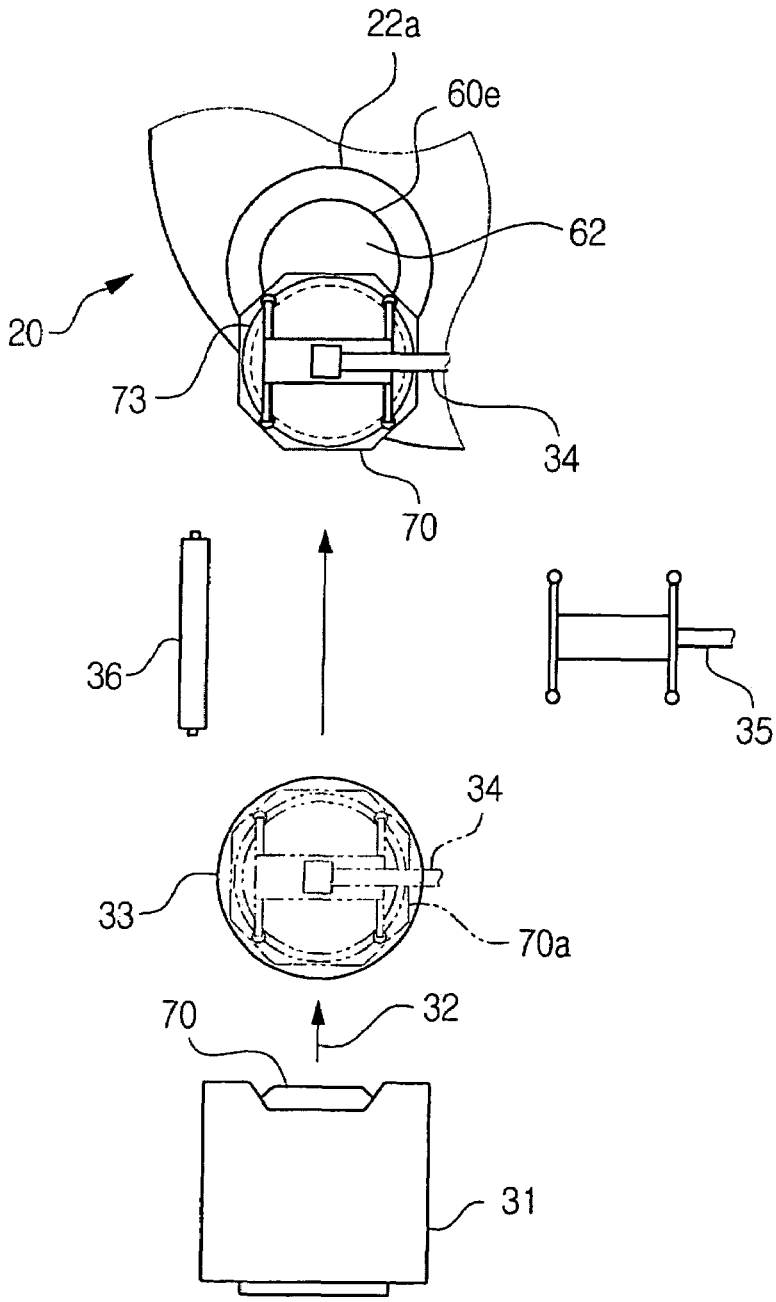
Figure 6B:
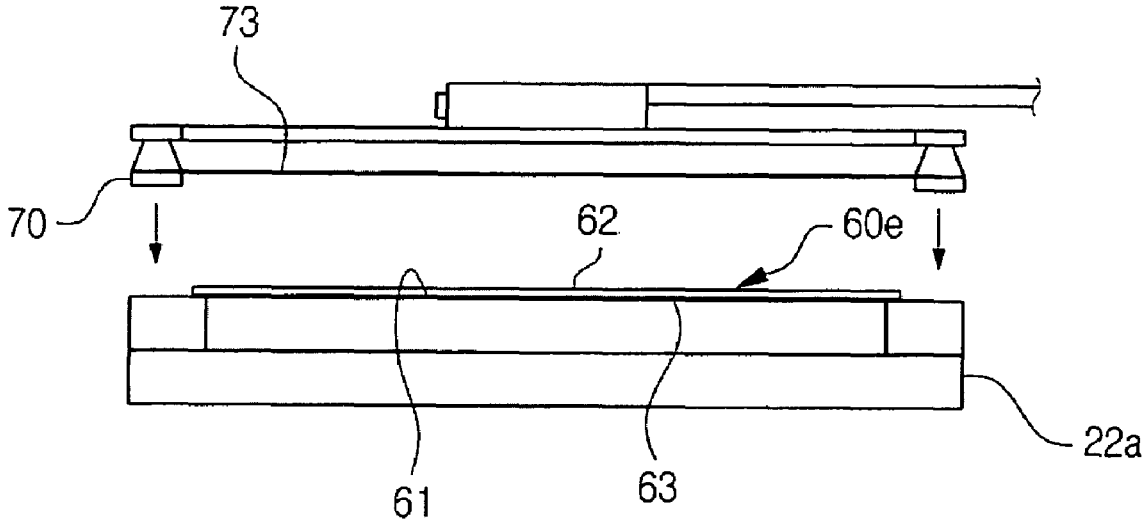

Referring to an example embodiment of the present invention shown in FIGS. 5A and 5B, the back side 62 of the wafer may be ground (92 of FIG. 3). While the grinding unit 20 may be rotated to change the positions of a second chuck table 22*b*, a third chuck table 22*c* and a fourth chuck table 22*d*, wafers 60*b*, 60*c* and 60*d* may be ground via a rough grinding process, a fine grinding process and a polishing and cleaning process, respectively. A thinned wafer 60*e* (e.g., a wafer that experienced the rough grinding process, a fine grinding process and/or a polishing and cleaning process) may be returned to the position of the first chuck table 22*a*. FIG. 5B shows the rough grinding process for grinding the back side 62 of the wafer 60*b*. According to an example embodiment of the present invention, the wafer 60*d* may be thicker than a target thickness by about 20 μm to about 30 μm after the rough grinding process using a rough grinding wheel 23*a* is completed.

Next, a tape attaching process may be performed. Referring to an example embodiment of the present invention shown in FIGS. 6A and 6B, a wafer ring 70 having dicing tape 73 may be provided to the grinding unit 20 (93 of FIG. 3). For example, the wafer ring 70 may be transferred from a wafer ring cassette 31 to a buffer stage 33 by a transfer arm 32 and then to the first chuck table 22*a* by a first transfer 34. According to an example embodiment of the present invention, the wafer ring 70 may be transferred so an adhesive surface of the dicing tape 73 may face the back side 62 of the wafer 60*e*.

Figure 7A:
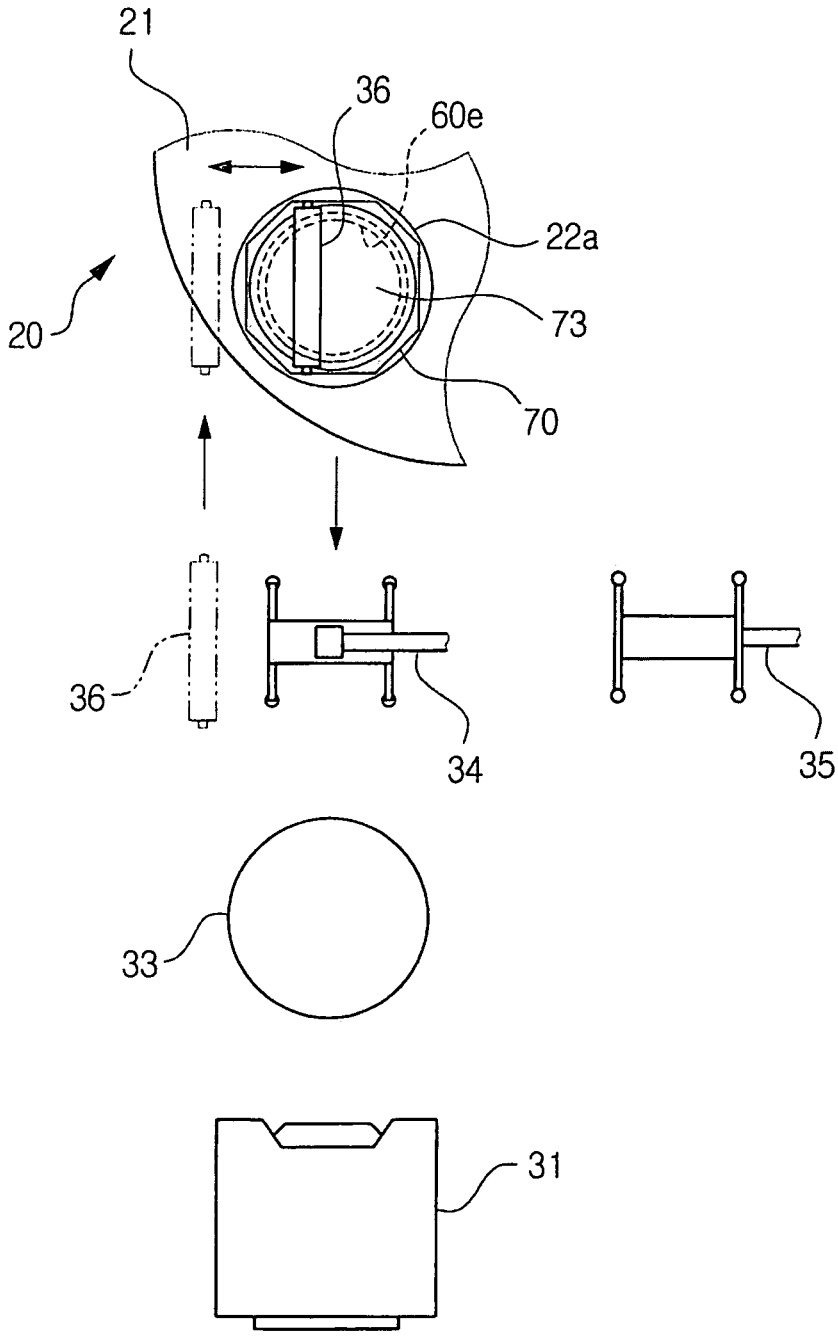
Figure 7B:
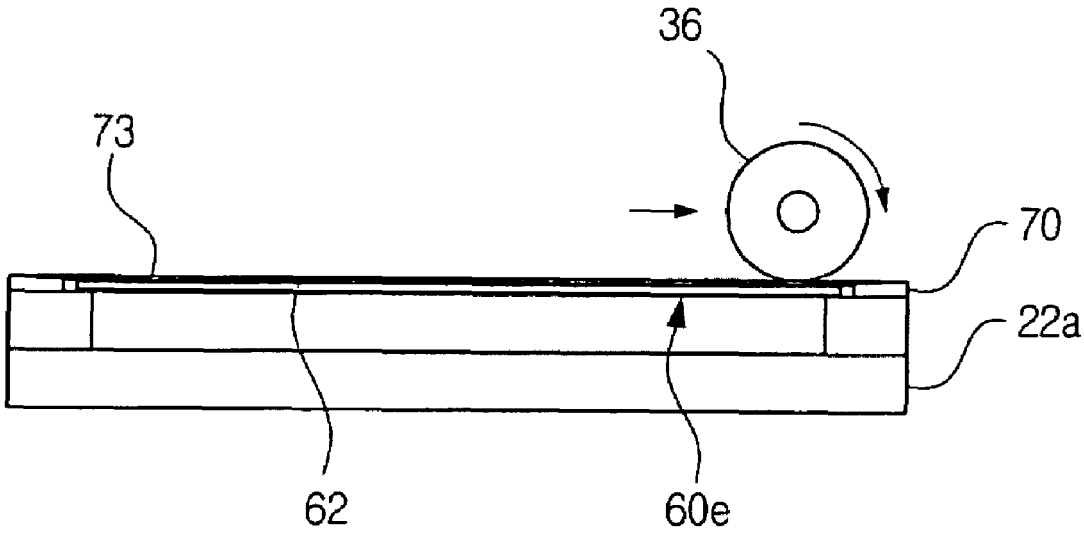

Referring to an example embodiment of the present invention as shown in FIGS. 7A and 7B, the dicing tape 73 may be attached to the back side 62 of the wafer 60*e* (94 of FIG. 3). A roller 36 may be located outside turntable 21 and may be moved above the first chuck table 22*a*. The roller 36 may roll on the dicing tape 73 using pressure and heat to adhere the dicing tape 73 to the back side 62 of the wafer 60*e*.

Figure 8A:
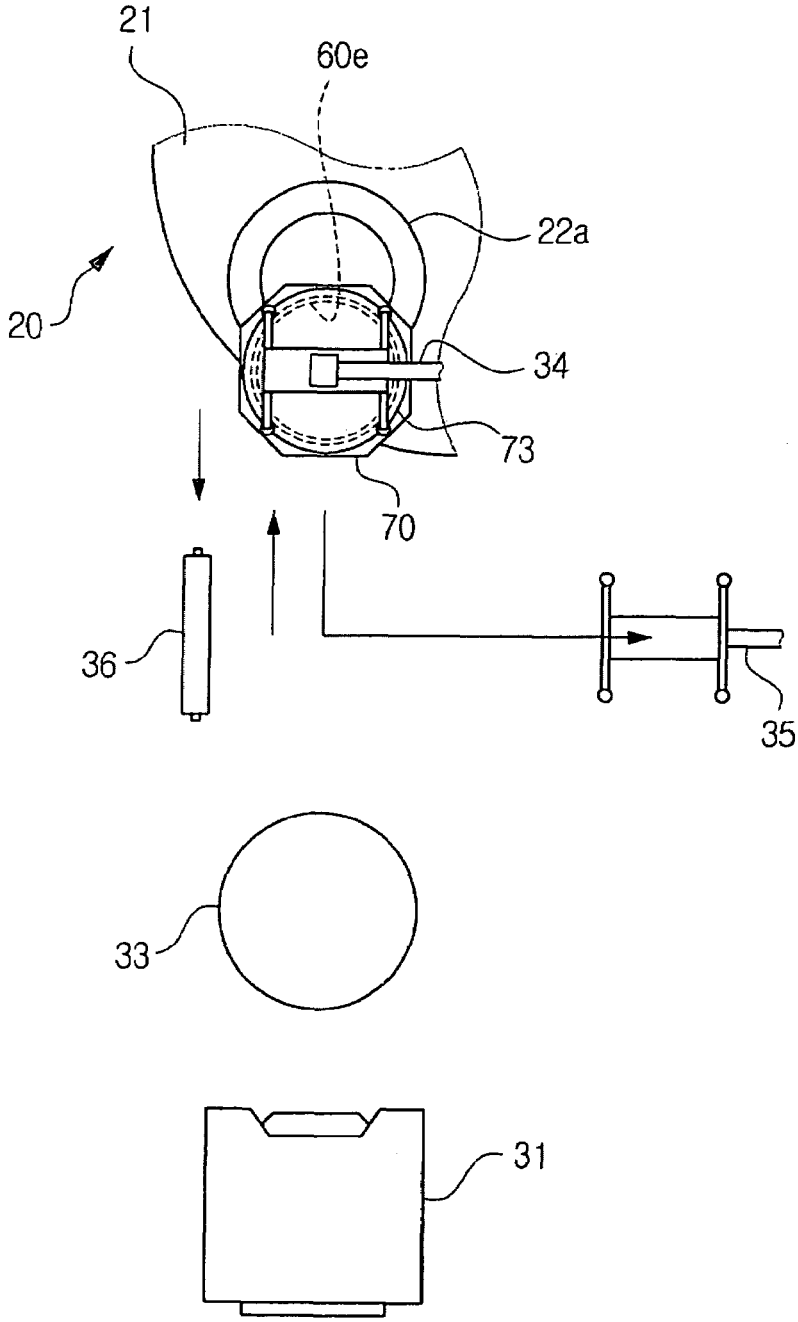
Figure 8B:
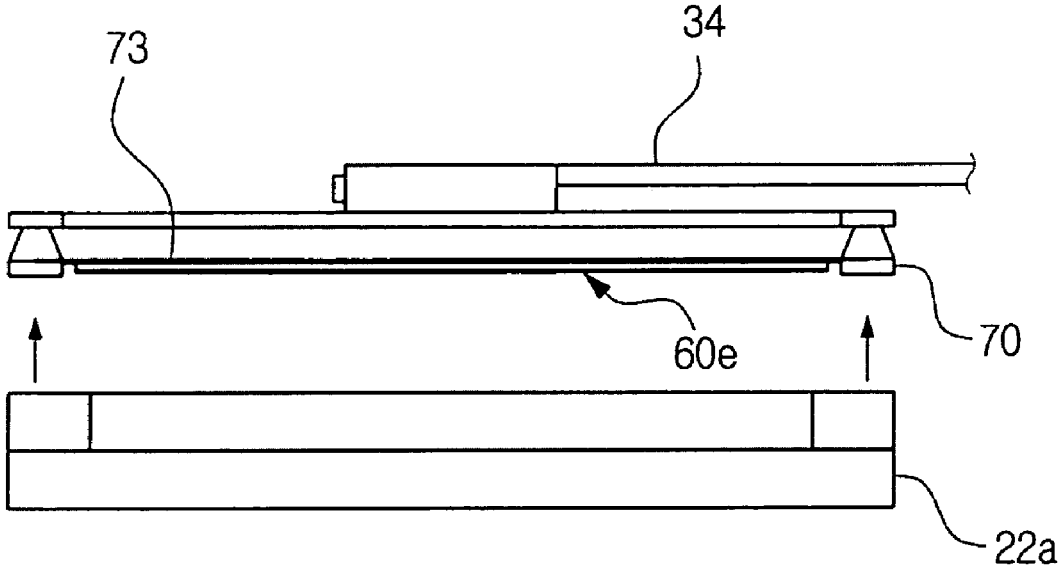

Referring to an example embodiment of the present invention as shown in FIGS. 8A and 8B, the wafer ring 70 may be unloaded from the grinding unit 20 (95 of FIG. 3). For example, a roller 36 may be restored to the original position of the roller 36. A first transfer 34 may be moved above the first chuck table 22*a*. The first transfer 34 may adsorb the wafer ring 70 having the wafer 60*e* using a vacuum, while the adsorption of the first chuck table 22*a* may be intercepted, removed and/or overcome. The first transfer 34 may be moved upward to transfer the wafer ring 70 from the grinding unit 20 to the tape removing unit (40 of FIG. 2).

In accordance with an example embodiment of the present invention, after a grinding process, the thinned wafer 60*e* may be unloaded from the grinding unit 20 with a wafer 60*e* being attached to a wafer ring 70.

Figure 9A:
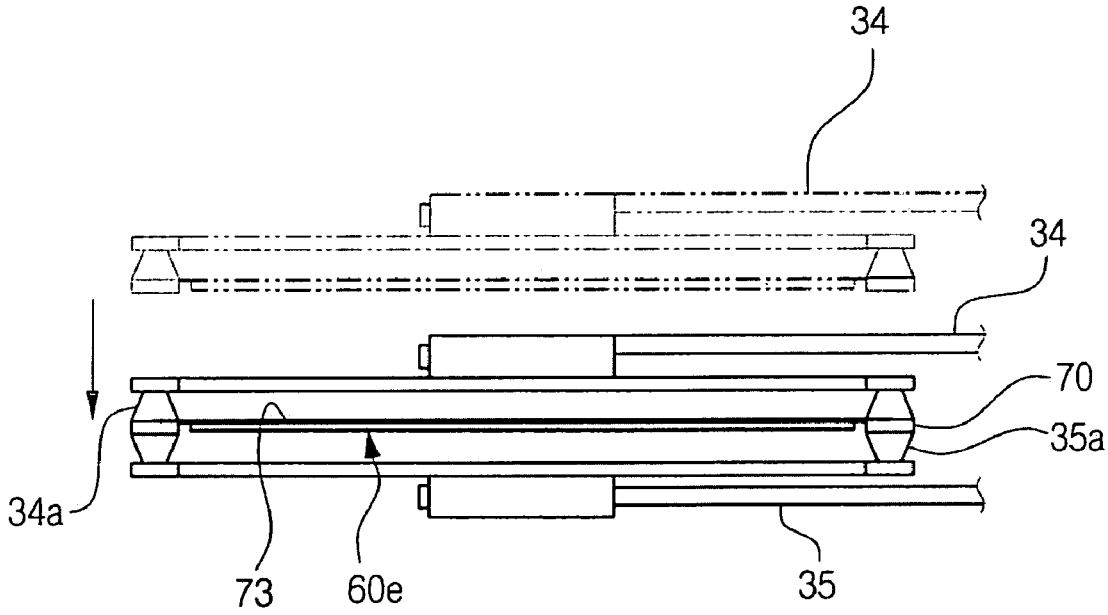
Figure 9B:
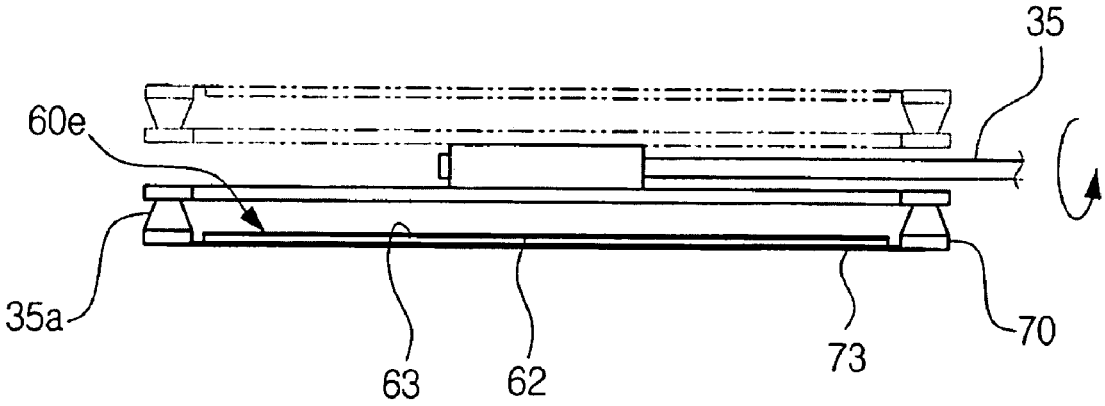

Referring to an example embodiment of the present invention as shown in FIGS. 9A and 9B, a wafer ring 70 may be flipped (96 of FIG. 3). As shown in FIG. 9A, the first transfer 34 may be moved above the second transfer 35, and a first adsorption unit 34*a* of the first transfer 34 may be moved downward to place the wafer ring 70 on a second adsorption unit 35*a* of the second transfer 35.

As shown in an example embodiment of the present invention in FIG. 9B, the second adsorption unit 35*a* may adsorb the wafer ring 70, while the first adsorption unit 34*a* may reduce and/or stop the vacuum applied to the wafer ring 70. The first transfer 34 may be slipped above the second transfer 35, and the adsorption unit 35*a* of the second transfer 35 may be turned over to flip the wafer ring 70. Accordingly, the front side 61 of the wafer 60*e* of the wafer ring 70 may face upward. The second transfer 35 may transfer the wafer ring 70 to the protection tape removing unit (40 of FIG. 2).

Figure 10:
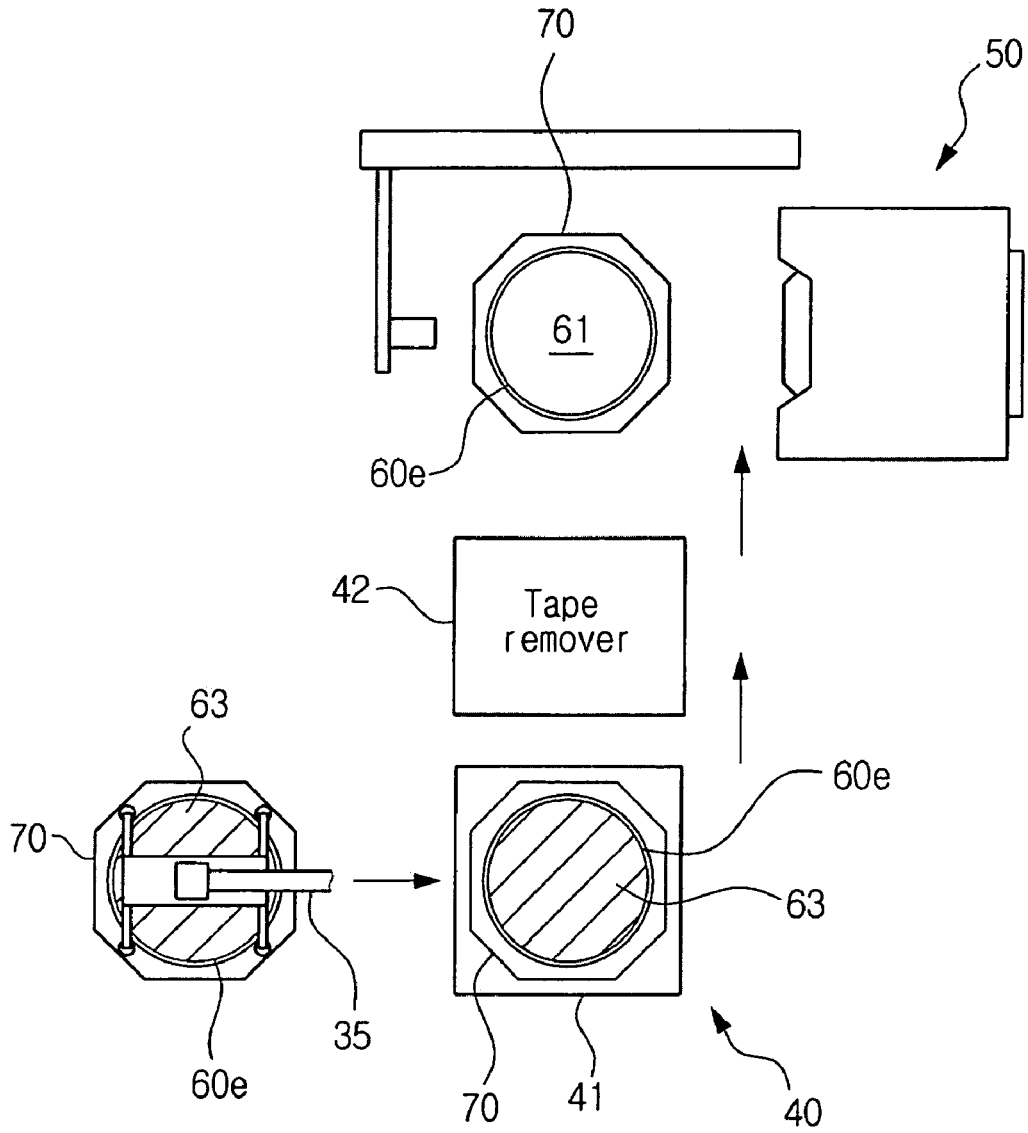

Referring to an example embodiment of the present invention shown in FIG. 10, protection tape 63 may be removed from the front side 61 of the wafer 60*e* (37 of FIG. 3). For example, an UV irradiator 41 may irradiate the protection tape 63 with UV rays to reduce the adhesive strength of the protection tape 63. A tape remover 42 may remove the protection tape 63 from the front side 61 of the wafer 60*e*.

Figure 11:
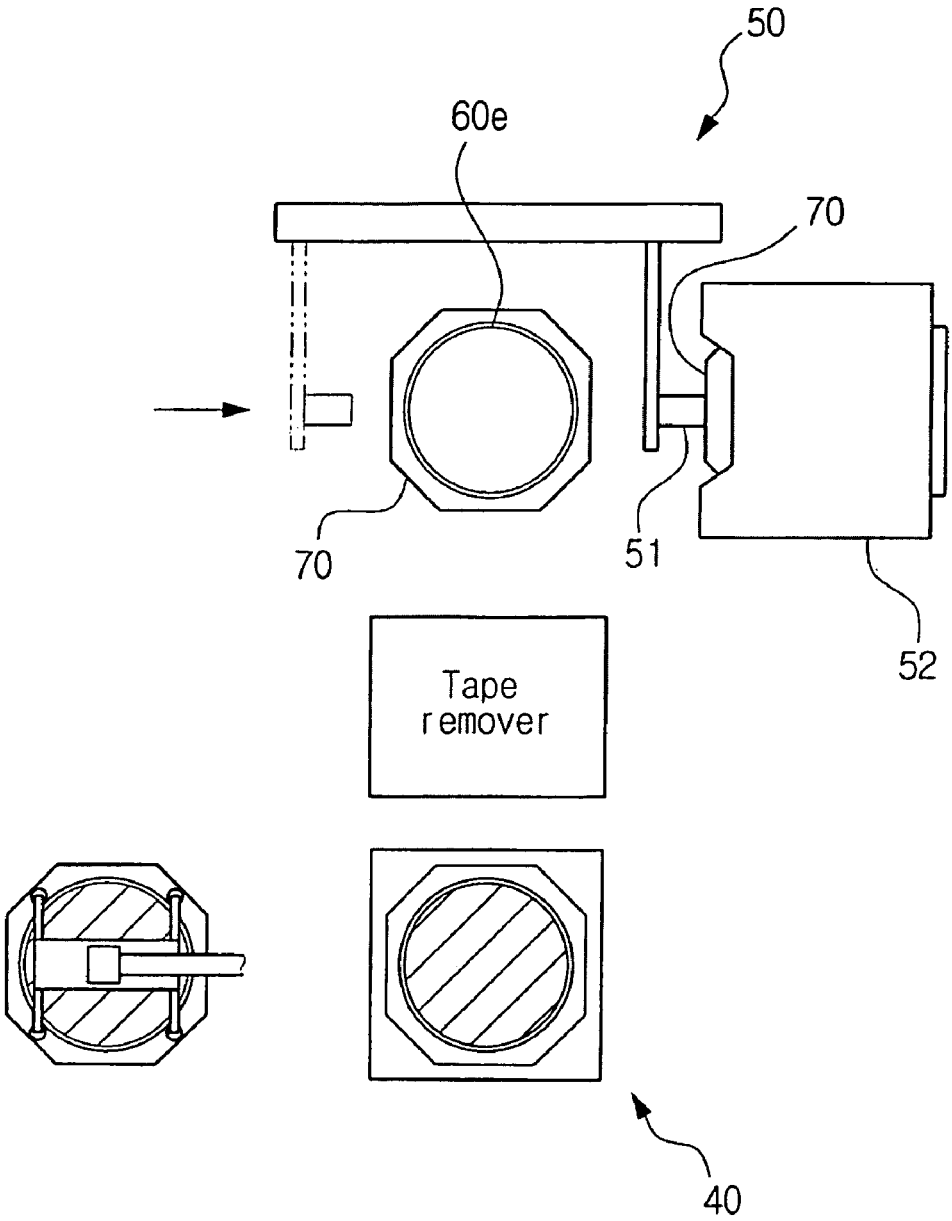

Referring to an example embodiment of the present invention shown in FIG. 11, the wafer ring 70 may be transferred to and/or received in a wafer ring receiving unit 50 (98 of FIG. 3). The wafer ring 70 may be transferred to the wafer ring cabinet 52 by an unloader 51.

In accordance with an example embodiment of the present invention, a tape attaching process may be performed on a first chuck table 22*a*. This may lead to stable adhesion between a wafer and dicing tape. For example, the thinned wafer created by a conventional device and or a conventional method may be subject to warpage, whereas a thinned wafer produced according to example embodiments of the present invention may be supported on a chuck table, whereby the likelihood of warpage of the thinned wafer may be reduced.

Further, according to example embodiments of the present invention, a thinned wafer is handled while the wafer is attached to a wafer ring. Accordingly, the thinned wafer may be stably handled during subsequent processes and damage which may occur to a wafer during handling may be reduced.

Figure 12:
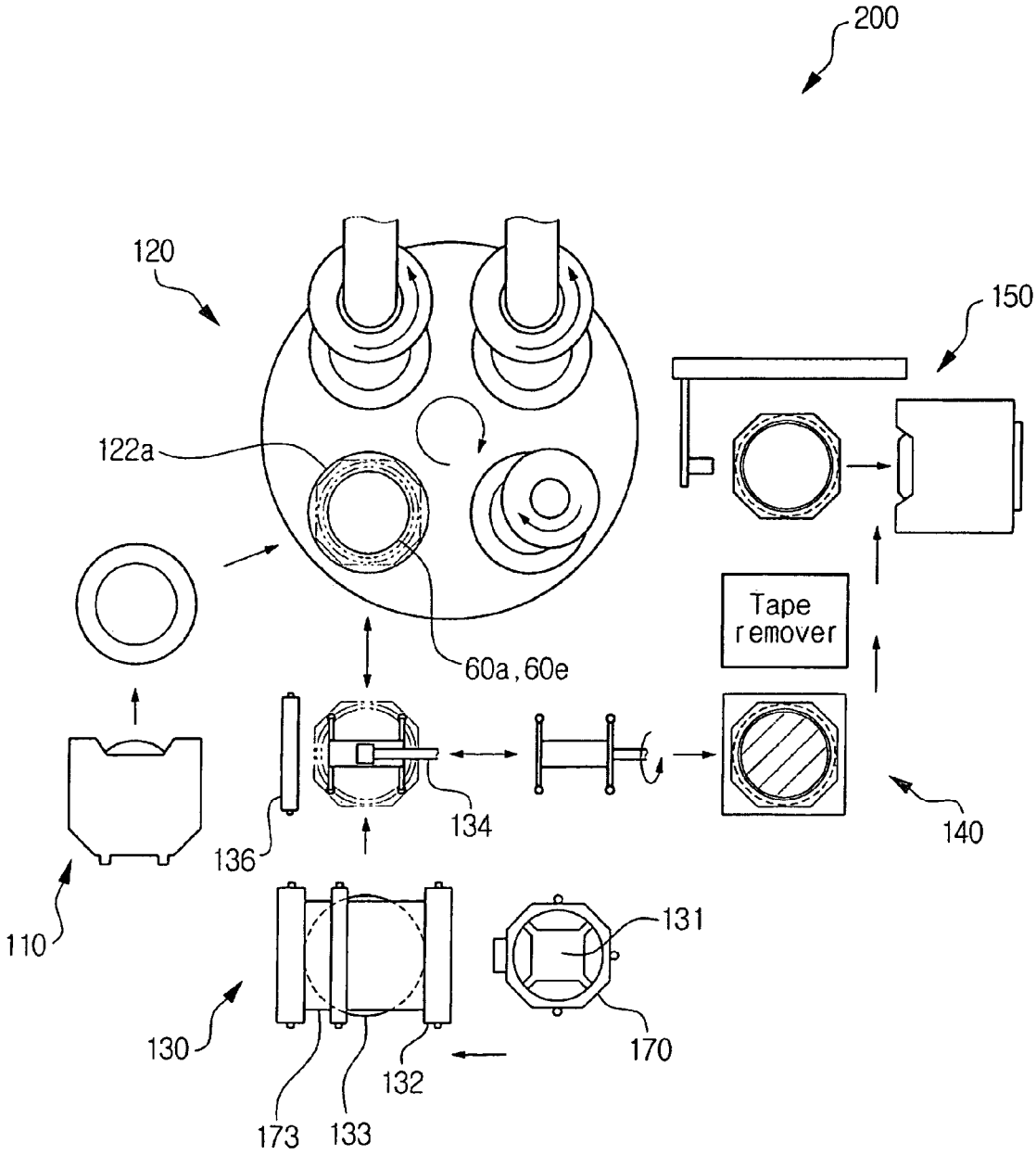
FIG. 12 is a block diagram of a wafer grinding and tape attaching apparatus and method according to an example embodiment of the present invention.

FIG. 12 is a block diagram of a wafer grinding and tape attaching apparatus 200 in accordance with an example embodiment of the present invention.

Referring to FIG. 12, a wafer grinding and tape attaching apparatus 200 may have the same structure as a previous example embodiment of the present invention described with respect to FIG. 2, except for a tape attaching unit 130 may have a tape attaching device 132. The wafer grinding and tape attaching apparatus 200 may include a wafer providing unit 110, a grinding unit 120, a tape attaching unit 130, a protection tape removing unit 140 and a wafer ring receiving unit 150.

The tape attaching unit 130 may include a wafer ring container 131, a mount table 133 and a tape attaching device 132. The ring container 131 may contain a wafer ring 170. The mount table 133 may support the wafer ring 170. The tape attaching device 132 may attach dicing tape 173 to the wafer ring 170. A first transfer 134 may provide the wafer ring 170 from the mount table 133 to a first chuck table 122*a*. A roller 136 may adhere a wafer 60*a* to the dicing tape 173. The first transfer 134 may unload the wafer ring 170 having a wafer 60*e* from the grinding unit 120.

A method for wafer grinding and tape attaching according to this example embodiment may include providing the wafer ring 170 having the dicing tape 173 to the first chuck table 122*a* after the dicing tape 173 is attached to the wafer ring 170.

Although example, non-limiting embodiments of the present invention have been described in detail hereinabove, it should be understood that variations and/or modifications of the basic inventive concepts herein taught, which may appear to those skilled in the art, still fall within the spirit and scope of example embodiments of the present invention.

What is claimed is:

1. A wafer grinding and tape attaching apparatus comprising:

a grinding unit configured to grind a back side of a wafer, the grinding unit including a plurality of chuck tables, one of the chuck tables being a buffer table for loading the wafer, attaching dicing tape to the wafer and unloading the wafer; and a tape attaching unit configured to provide a wafer ring including dicing tape to the buffer table of the grinding unit supporting a ground wafer and to attach the dicing tape to the back side of the ground wafer, wherein each of the plurality of chuck tables has a corresponding grinding wheel except for the chuck table functioning as the buffer table.

2. The apparatus of claim 1, further comprising:

a wafer providing unit configured to provide the wafer to the grinding unit.

3. The apparatus of claim 1, further comprising:

a wafer ring receiving unit configured to receive the wafer ring having the ground wafer.

4. The apparatus of claim 1, wherein the grinding unit further includes a turntable having a plurality of chuck tables radially arranged thereon, the turntable configured to rotate to change the position of the plurality of chuck tables.

5. The apparatus of claim 1, further comprising:

a tape remover configured to remove a protection adhesive from the ground wafer.

6. The apparatus of claim 5, wherein the wafer ring receiving unit includes an unloader configured to unload the wafer ring from the tape remover; and a wafer ring cabinet configured to receive the wafer ring.

7. A wafer grinding and tape attaching apparatus comprising:

a grinding unit including at least one chuck table and grinding wheel, the at least one chuck table is configured to support a wafer having a front side and a back side, and the grinding wheel is configured to grind the back side of the wafer; and a tape attaching unit configured to provide a wafer ring including dicing tape to a chuck table supporting a ground wafer and to attach the dicing tape to the back side of the ground wafer; and a wafer ring receiving unit configured to receive the wafer ring having the ground wafer, wherein the at least one chuck table includes at least one grinding table and a buffer table, the at least one grinding table is configured to grind the back side of the wafer, and the buffer table is configured to provide the wafer to the at least one grinding table and to provide the wafer ring having the ground wafer to the wafer ring receiving unit.

8. The apparatus of claim 7, wherein the tape attaching unit includes a wafer ring cassette located near the buffer table and configured to contain the wafer ring having the dicing tape; a first transfer configured to transfer the wafer ring from the wafer ring cassette to the buffer table and to unload the wafer ring having the ground wafer from the grinding unit; and a roller configured to attach the dicing tape to the back side of the ground wafer.

9. The apparatus of claim 8, wherein the tape attaching unit further includes a second transfer configured to flip the ground wafer to face the front side of the ground wafer upward.

10. The apparatus of claim 7, wherein the tape attaching unit includes a wafer ring container configured to contain the wafer ring; a tape attaching device configured to attach the dicing tape to the wafer ring; a first transfer configured to load the wafer ring having the dicing tape to the buffer table having the wafer and to unload the wafer ring having the ground wafer from the grinding unit; and a roller configured to attach the dicing tape to the back side of the ground wafer.

11. The apparatus of claim 10, wherein the tape attaching unit further includes a second transfer configured to flip the ground wafer to face the front side of the ground wafer upward.

12. A method for wafer grinding and tape attaching, the method comprising:

grinding a back side of the wafer using a grinding wheel, the wafer being supported on a grinding unit including a plurality of chuck tables, one of the chuck tables being a buffer table for loading the wafer, each of the chuck tables having a corresponding grinding wheel except for the chuck table functioning as the buffer table, attaching the dicing tape and unloading the wafer;

providing a wafer ring having dicing tape to the buffer table having the ground wafer; and attaching the dicing tape to the back side of the ground wafer.

13. The method of claim 12, further comprising:

providing the wafer to the buffer table such that a back side of the wafer is facing upward; and unloading the wafer ring having the ground wafer from the buffer table.

14. The method of claim 12, wherein providing the wafer ring includes preparing a wafer ring cassette;

receiving the wafer ring having the dicing tape; and transferring the wafer ring to the buffer table having the ground wafer to mount the dicing tape to the back side of the ground wafer.

15. The method of claim 12, wherein providing the wafer ring includes preparing a wafer ring container having the wafer ring;

attaching the dicing tape to the wafer ring; and transferring the wafer ring having the dicing tape to the buffer table having the ground wafer to mount the dicing tape to the back side of the wafer.

16. The method of claim 12, wherein attaching the dicing tape to the back side of the ground wafer includes pressing a roller onto the back side of the ground wafer using heat to adhere the dicing tape to the back side of the ground wafer.

17. The method of claim 12, wherein a front side of the wafer has protection tape attached thereto and the method further comprises removing the protection tape from the ground wafer and receiving the wafer ring having the ground wafer in a wafer ring cabinet.

18. A method for wafer grinding and tape attaching, the method comprising:

grinding a back side of the wafer using a grinding wheel, the wafer being supported on a chuck table;

providing a wafer ring having dicing tape to the chuck table having the ground wafer; and attaching the dicing tape to the back side of the ground wafer;

removing protection tape from the ground wafer and receiving the wafer ring having the ground wafer in a wafer ring cabinet; and flipping the wafer ring to face a front side of the ground wafer upward before removing the protection tape.

* * * * *